US011230899B2

(12) United States Patent
Stewart et al.

(10) Patent No.: US 11,230,899 B2
(45) Date of Patent: Jan. 25, 2022

(54) WELL ABANDONMENT AND SLOT RECOVERY

(71) Applicant: Ardyne Holdings Limited, Aberdeen (GB)

(72) Inventors: David Stewart, Aberdeen (GB); Lukas David, Aberdeen (GB); James Linklater, Aberdeen (GB)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 0 days.

(21) Appl. No.: 16/766,949

(22) PCT Filed: Nov. 29, 2018

(86) PCT No.: PCT/GB2018/053462
§ 371 (c)(1),
(2) Date: May 26, 2020

(87) PCT Pub. No.: WO2019/106374
PCT Pub. Date: Jun. 6, 2019

(65) Prior Publication Data

US 2021/0032948 A1 Feb. 4, 2021

(30) Foreign Application Priority Data

Nov. 30, 2017 (GB) ..... 1719956

(51) Int. Cl.
*E21B 29/00* (2006.01)
*E21B 23/04* (2006.01)
*E21B 23/01* (2006.01)

(52) U.S. Cl.
CPC ..... *E21B 29/005* (2013.01); *E21B 23/01* (2013.01); *E21B 23/0411* (2020.05)

(58) Field of Classification Search
CPC .... E21B 29/005; E21B 31/20; E21B 23/0411; E21B 23/01
See application file for complete search history.

(56) References Cited

U.S. PATENT DOCUMENTS 2,280,769 A * 4/1942 Page ..... E21B 29/005 451/465
4,047,568 A * 9/1977 Aulenbacher ..... E21B 23/00 166/298

(Continued)

FOREIGN PATENT DOCUMENTS

EP 1241321 A2 9/2002
GB 2548727 A 9/2017

(Continued)

OTHER PUBLICATIONS

Intellectual Property Office (UK); Combined Search and Examination Report far GB1719956.3; dated Jan. 11, 2018; entire document; Intellectual Property Office (UK), Newport, South Wales, UK.

(Continued)

*Primary Examiner* — Shane Bomar
(74) *Attorney, Agent, or Firm* — Law Office of Jesse D. Lambert, LLC

(57) ABSTRACT

A downhole casing cutting and removal assembly (10) and method of use thereof, the assembly comprising a work string (23) with a cutting mechanism (18) and plurality of resettable anchor mechanisms (20B-20D). The arrangement allows a test pull to be made following the cut by an anchor mechanism closer to the upper end of the cut casing section than an anchor mechanism (20B-20D) located close to the cutting mechanism. Time is thus saved by not having to raise and lower a single anchor mechanism (20B-20D) between the cutting position and the upper end of the cut casing section to undertake a test pull.

19 Claims, 3 Drawing Sheets

(56) References Cited

U.S. PATENT DOCUMENTS

| | | | | |
|---|---|---|---|---|
| 6,629,565 | B2 * | 10/2003 | Harrell | E21B 23/00 166/178 |
| 6,679,328 | B2 * | 1/2004 | Davis | E21B 47/095 166/298 |
| 6,868,901 | B2 * | 3/2005 | Mason | E21B 23/01 166/55.7 |
| 7,380,603 | B2 * | 6/2008 | Jeffrey | E21B 23/01 166/285 |
| 2005/0263282 | A1 | 12/2005 | Jeffrey et al. | |
| 2012/0318509 | A1 | 12/2012 | Fuhst et al. | |
| 2015/0275605 | A1 * | 10/2015 | Bennett | E21B 33/134 166/298 |
| 2016/0108690 | A1 * | 4/2016 | Searight | E21B 29/002 166/206 |
| 2016/0130904 | A1 | 5/2016 | Andersen | |
| 2016/0265294 | A1 | 9/2016 | Robertson et al. | |
| 2019/0162033 | A1 * | 5/2019 | Engevik | E21B 31/20 |
| 2021/0079747 | A1 * | 3/2021 | Grindhaug | E21B 29/005 |
| 2021/0198961 | A1 * | 7/2021 | Telfer | E21B 23/01 |
| 2021/0198967 | A1 * | 7/2021 | Linklater | E21B 10/322 |
| 2021/0246748 | A1 * | 8/2021 | Delgado | B23H 5/14 |

FOREIGN PATENT DOCUMENTS

| | | | |
|---|---|---|---|
| WO | WO 99/57409 | A2 | 11/1999 |
| WO | WO 2014/174288 | A1 | 10/2014 |
| WO | WO 2017/046613 | A1 | 3/2017 |
| WO | WO 2017/182549 | A1 | 10/2017 |

OTHER PUBLICATIONS

European Patent Office (as Int'l Search Authority), International Search Report and Written Opinion for PCT/GB2018/053462; dated Mar. 21, 2019; entire document; European Patent Office, Rijswijk (NL).

* cited by examiner

WELL ABANDONMENT AND SLOT RECOVERY

FIELD OF THE INVENTION

Background of the Invention

The present invention relates to methods and apparatus for well abandonment and slot recovery and in particular, though not exclusively, to a method and apparatus for casing recovery.

When a well has reached the end of its commercial life, the well is abandoned according to strict regulations in order to prevent fluids escaping from the well on a permanent basis. In meeting the regulations, it has become good practise to create the cement plug over a predetermined length of the well and to remove the casing. Current techniques to achieve this may require multiple trips into the well, for example: to set a bridge plug to support cement; to create a cement plug in the casing; to cut the casing above the cement plug; and to pull the casing from the well. A further trip can then be made to cement across to the well bore wall. The cement or other suitable plugging material forms a permanent barrier to meet the legislative requirements.

Each trip into a well takes substantial time to make-up and break-out the work string and consequently represents significant costs in well abandonment and slot recovery. Combined casing cutting and pulling tools have been developed so that the cutting and pulling can be achieved on a single trip.

A combined cutting and pulling tool is described in GB1702897.8 and typically comprises a cutting tool for severing the casing and an anchor or spear designed to grip the inner wall of the casing so that it can be recovered from the well. In use, the cutting tool and the anchor are located together at or near the end of the work string. They are run in the casing to a maximum depth, the anchor is set and the cutting tool operated to cut the longest length of casing possible. Once the casing section is severed, the anchor is unset and repositioned at the top of the cut section of casing. The work string is then pulled out of the hole to recover the casing. However, the presence of drilling fluid sediments, cement, sand or other debris behind the casing can prevent the casing from being pulled. In this event, the anchor must be unset and the string is run back through the casing to position the cutting tool at a shallower depth for another cut to be made. Once that cut is made the anchor is again unset and repositioned at the top of the cut section of casing. The work string is then pulled again to see if the shorter length of casing can be recovered. The steps are repeated until a section of casing can be recovered.

As each of the cut sections of casing can be several hundred metres long, each repositioning of the anchor to check that the cut section of casing is free and each failed pull takes a significant amount of time in breaking-out and making-up the work string. The time taken can be nearly the same as for tripping out of the well when the upper end of the cut casing is near the surface. Thus, the combined casing and cutting tool of the prior art can provide little advantage in time and cost savings over separate cutting and pulling trips in the well.

It is a therefore an object of the present invention to provide a method of removing casing from a wellbore which obviates or mitigates at least some of the disadvantages of the prior art.

It is a further object of the present invention to provide a casing cutting and removal assembly which obviates or mitigates at least some of the disadvantages of the prior art.

SUMMARY OF THE INVENTION

According to a first aspect of the present invention there is provided a method of removing casing from a wellbore, comprising the following steps, performed on a single trip, in order:

(a) providing a work string including:
- a cutting mechanism configured to cut a tubular in the wellbore; and
- a first anchor mechanism and a second anchor mechanism, each anchor mechanism configured to grip an inner wall of the tubular in a wellbore; and
- wherein the cutting mechanism is positioned towards a lower end of the work string and the first and the second anchor mechanisms are spaced apart along the work string above the cutting mechanism, the first anchor mechanism being arranged between the cutting mechanism and the second anchor mechanism;

(b) running the work string in the well bore to position the cutting mechanism at a first depth in the tubular;

(c) actuating the cutting mechanism to cut the tubular to form a cut section of tubular above the position of the cutting mechanism;

(d) actuating the second anchor mechanism to grip the cut section of tubular;

(e) pulling the work string to check that the cut section of tubular is free;

(f) releasing the second anchor mechanism;

(g) pulling the work string up through the wellbore so as to position the first anchor mechanism towards an upper end of the cut section of tubular;

(h) actuating the first anchor mechanism to grip the cut section of tubular; and (i) pulling the work string from the well bore to remove the cut section of tubular from the wellbore.

By having a second anchor mechanism on the work string, the work string does not have to be raised and lowered to reposition the first anchor mechanism in the bottom hole assembly at the top of the cut section of casing to check that the cut section of tubular is free to be pulled. This saves time and improves efficiency and cost.

Preferably, the first anchor mechanism is mounted above and in proximity to the cutting mechanism. In this way, the first anchor mechanism and the cutting mechanism can be considered as a bottom hole assembly. The bottom hole assembly may further include a packer. In this way, the bottom hole assembly may be a standard cutting and pulling tool such as the TRIDENT® System available from Ardyne Technologies Limited.

Preferably, the method includes the step of actuating the first anchor mechanism during step (c). In this way, the tubular is held in tension when the cut is performed. The tubular may be casing, liner, pipe, production tubing or the like located in the wellbore.

The method may include the step of raising the work string between steps (c) and (d) to position the second anchor mechanism closer to an upper end of the cut section of tubular. In this way, the anchor mechanism closest to the upper end of the cut section of tubular is used and the depth of the cut is not dependent on the position of the second anchor mechanism above the cutting mechanism. This step of raising the work string may actuate the second anchor mechanism as the second anchor mechanism exits the upper end of the tubular. In this way, the second anchor mechanism acts as a casing spear as per the FRM spear available from Ardyne Technologies Limited.

Preferably, in the event that the cut section of tubing is not free in step (e), the method includes these additional steps between steps (f) and (g):

f(1) positioning the cutting mechanism at a shallower depth in the tubular;

f(2) actuating the cutting mechanism to cut the tubular to form a shorter cut section of tubular above the position of the cutting mechanism;

f(3) actuating the second anchor mechanism to grip the shorter cut section of tubular;

f(4) pulling the work string to check that the cut section of tubular is free; and f(5) releasing the second anchor mechanism.

The method may include the step of lowering the work string in step f(1). Where the work string was raised between steps (c) and (d), the lowering will need only be done over a distance equal to the distance traveled by the work string when it was raised to position the second anchor mechanism minus the distance between the cuts.

Preferably, the method includes the step of actuating the first anchor mechanism during step f(2).

The method may include the step of raising the work string between steps f(2) and f(3).

Alternatively, the method may include locating a third anchor mechanism on the work string with the third anchor mechanism located between the first and second anchor mechanisms.

Preferably, in the event that the cut section of tubing is not free in step (e), the method includes these additional steps between steps (f) and (g):

f(1) positioning the cutting mechanism at a shallower depth in the tubular;

f(2) actuating the cutting mechanism to cut the tubular to form a shorter cut section of tubular above the position of the cutting mechanism;

f(3) actuating the third anchor mechanism to grip the shorter cut section of tubular;

f(4) pulling the work string to check that the cut section of tubular is free; and f(5) releasing the third anchor mechanism.

In this way, in a single trip, a shorter section of casing can be cut and attempted to be pulled without requiring the first anchor mechanism to be repositioned in the wellbore.

Preferably, the additional steps are repeated at successively shallower depths and with other anchor mechanisms on the work string until a cut section of tubular is free. In this way, the work string only needs to be raised after the cut at the first depth during the method.

It will be appreciated that some adjustment of the work string such as applying tension, releasing tension and rotation in either direction may be required to operate the cutting mechanism and anchor mechanisms.

The method may comprise hydraulically or pneumatically actuating the anchor mechanisms. The method may comprise mechanically setting the anchor mechanisms. The method may comprise setting the anchor mechanisms by providing an upward force or tension to the bottom hole assembly.

The method may comprise actuating the cutting mechanism by pumping a fluid into a bore of the work string and rotating the cutting mechanism to cut the casing. The cutting mechanism may be rotated by rotating the work string. Alternatively, the cutting mechanism may be rotated via a downhole motor arranged between the lowermost anchor mechanism and the cutting mechanism.

According to a second aspect of the invention there is provided a downhole casing cutting and removal assembly comprising:

a work string for running inside a tubular in a wellbore;

a cutting mechanism being mounted in the work string and configured to cut the tubular to form a cut tubular section;

a plurality of anchor mechanisms, each anchor mechanism being mounted in the work string and configured to grip a section of the tubular;

wherein the plurality of anchor mechanisms are spaced apart along the work string above the cutting mechanism.

In this way, when the tubular is cut an anchor mechanism will be positioned at or near an upper end of the cut section of tubular so that the cut section can be tested to see if it is free.

A lowermost anchor mechanism and the cutting mechanism may be arranged together as a bottom hole assembly. In this way, a standard combined cutting and pulling tool can be used. The bottom hole assembly may include a packer. The bottom hole assembly may be as described in WO2017046613 and incorporated herein by reference. The bottom hole assembly may be the TRIDENT® system available from Ardyne Technologies Limited.

Preferably the anchor mechanisms are resettable. The anchor mechanisms may be configured to independently grip a section of a casing at any axial position in the wellbore. In this way, each anchor mechanism can be used as a spear for casing removal. Alternatively, one or more of the anchor mechanisms excluding the lowermost anchor mechanism, may be configured to grip the upper end of casing so that they only anchor when required to pull the casing. One or more anchor mechanisms may therefore be as described in WO2017182549 incorporated herein by reference. One or more of the anchor mechanisms may be the Flow Release Mechanical Spear (FRM) available from Ardyne Technologies Limited which grips the upper end of casing.

Preferably the work string comprises sections of pipe having a through bore. More preferably, the pipe is drill pipe and the work string is a drill string as is known in the art. In this way, fluids can be circulated through the bore to operate the anchor mechanisms and/or the cutting mechanism. Alternatively, the work string may be coiled tubing or wireline.

Preferably, the anchor mechanisms are spaced apart on the work string in relation to the cutting mechanism so as to locate the cutting mechanism away from joints in the tubular when an anchor mechanism is located at an upper end of the tubular to be cut. In this way, the cutting mechanism can be arranged to avoid cutting through casing collars.

The cutting mechanism may comprise at least one blade or knife. Preferably the cutting mechanism comprises a plurality of knives. The plurality of knives may be circumferentially disposed about a section of the cutting mechanism.

Preferably, a lowermost anchor mechanism and cutting mechanism are in close proximity. In this way, the structural integrity of the knives of the cutting mechanism may be preserved and their life span extended by avoiding damage due to vibration. The close proximity of the lowermost anchor mechanism to the cutting mechanism also provides a secure hold and prevents chattering when the knives engage and start to cut the casing. This allows the cutting mechanism to perform a number of downhole cuts in a single trip without having to return to surface for knife and/or tool repairs.

The work string may further comprise a drill, the drill being located at a distal end of the work string below the cutting mechanism. Mounting a drill bit on the end of the work string allows initial dressing of a cement plug prior to casing cutting being achieved on the same trip into the wellbore.

Alternatively, the work string may further comprise a bridge plug, the bridge plug being located at a distal end of the work string below the cutting mechanism. Mounting a bridge plug on the end of the work string allows setting of a bridge plug in the casing prior to casing cutting being achieved on the same trip into the wellbore.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Use of terms such as "upper" and "lower" are considered relative and though the well bore is drawn in the ideal vertical orientation, it will be appreciated that this may be deviated. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

BRIEF DESCRIPTION OF THE DRAWINGS

There will now be described, by way of example only, various embodiments of the invention with reference to the drawings, of which.

DETAILED DESCRIPTION OF THE INVENTION

Figures 1A, 1B, 1C, 1D, 1E, 1F:
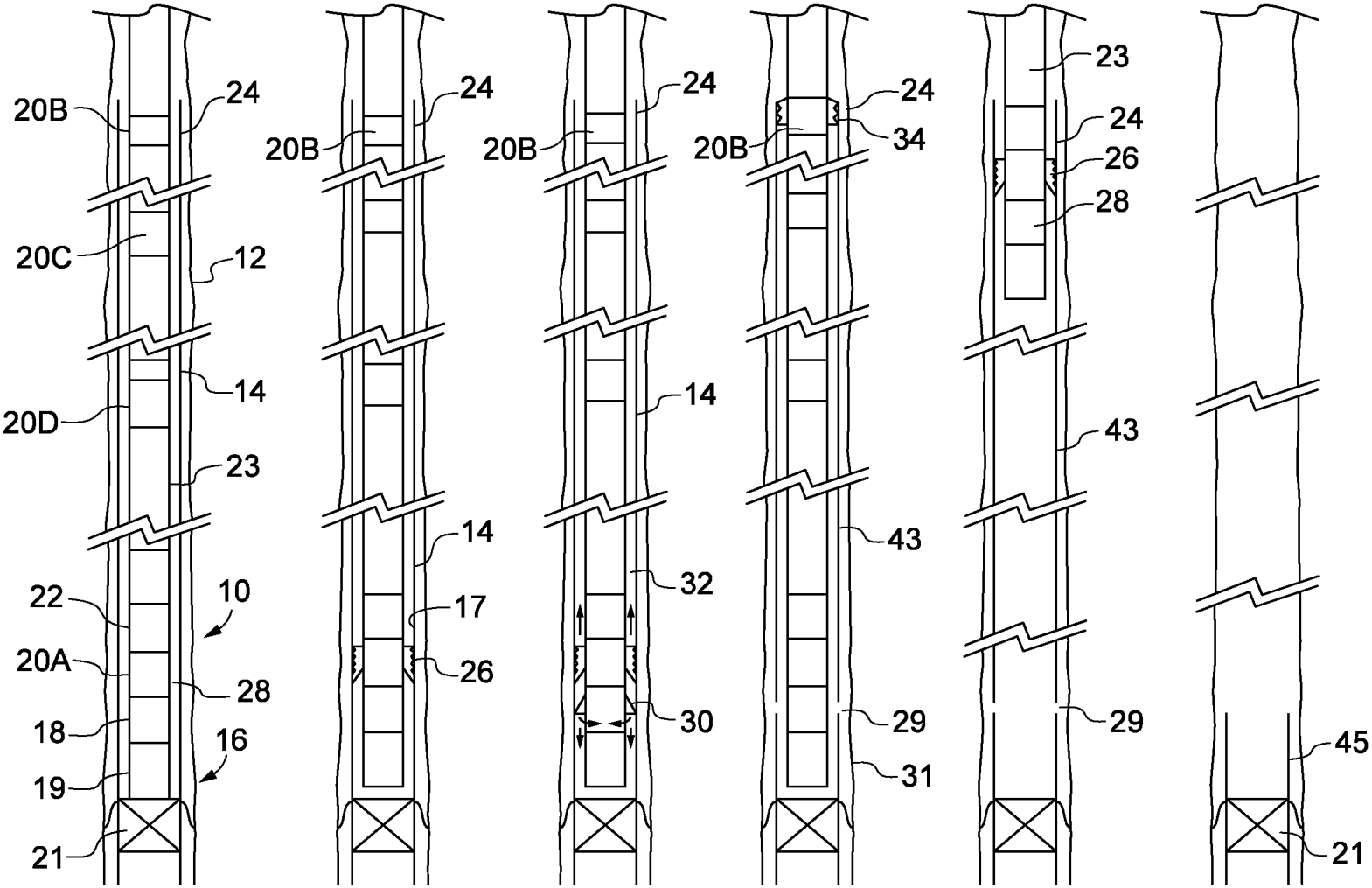
FIGS. 1A to 1F provide schematic illustrations of a method according to an embodiment of the present invention.

Referring initially to FIG. 1A of the drawings there is illustrated a downhole casing cutting and removal assembly, generally indicated by reference numeral 10, according to an embodiment of the present invention run into a wellbore 12 which is lined with casing 14 or other tubular. Assembly 10 includes, from a first end 16, a bottom hole assembly 28 comprising a cutting mechanism 18, a lowermost anchor mechanism 20A and a packer 22. The bottom hole assembly 28 is attached to a work string 23 which is formed of sections of drill pipe and may be referred to as a drill string. The assembly 10 is further provided with a number of additional anchor mechanisms 20B-20D spaced apart progressively further from first end 16 on the work string 23.

Although shown as four anchor mechanisms 20A-D, there may be two or more, with a lowermost anchor mechanism near the cutting mechanism 18 and a first anchor mechanism 20B spaced apart along the work string 23. Ideally the separation between the lowermost anchor mechanism 20A and the first anchor mechanism 20B is approximately equal to the desired length of casing 14 to be removed from the wellbore 12. The anchor mechanisms 20A-D need not be equally spaced, their separation may be selected so as that when the first anchor mechanism 20B is at an upper end 24 of the casing 14, the cutting mechanism 18 is positioned away from any joints in the casing 14, such as casing collars, which would be more difficult to cut than casing between the joints.

The anchor mechanisms 20A-D need not be identical either, though they must all be actuable downhole to grip and anchor the work string 23 to the casing 14 in the well bore 12. In a preferred embodiment the lowermost anchor mechanism 20A is as described in WO2017046613, incorporated herein by reference and is designed to set grippers 26 against the inner wall 17 of the casing 14 by applying tension to the work string 23. The anchor mechanism 20A also has the feature of being rotatable through when set. In this way, rotation of the work string 23 at surface is transmitted to the cutter mechanism 18 sitting below the anchor mechanism 20A. The remaining anchor mechanisms 20B-D may be alternative designs as would be found in typical casing spears. Such a spear is described in WO2017182549, incorporated herein by reference, and available as the Flow Release Mechanical Spear (FRM) from Ardyne Technologies Limited. The FRM is operated by pulling the spear out of the top of the casing to grip the inner wall of the casing at the upper end of the casing. The spear is released via flow in a through bore of the work string 23. By having differing anchor mechanisms 20A,20B, they can be set independently in the casing 12. All the anchor mechanisms 20A-D must be reversibly set so that they can be released from gripping the inner wall 17 of the casing 14.

The cutting mechanism 18 may be any design of downhole casing cutter. In the preferred embodiment the cutting mechanism 18 is as described in WO2017046613, incorporated herein by reference. In this way, cutting mechanism 18 can be operated independently of lowermost anchor mechanism 20A. The cutting mechanism 18 includes a plurality of blades 30 which are retracted until cutting is required. Fluid pressure in the through bore and/or a drop ball may be used to activate and de-activate the movement of the blades. When extended and the work string 28 rotated, the blades 30 will cut through the casing 14. The blades 30 are sized such that were the casing being removed sits inside an outer casing or liner, only the innermost casing is severed.

In the embodiment described there is also a packer 22 in the bottom hole assembly 28. As is known the art a typical packer 22 comprises a packer element typically made from a material capable of radially expanding when it is axially compressed such as a rubber or other elastomeric material. In the preferred embodiment the packer 22 is as described in GB2548727. This is a mechanical tension-set packer 22 which advantageously can be set rapidly in the event of a kick during casing cutting.

The bottom hole assembly 28 comprising the cutting mechanism 18, lowermost anchor mechanism 20A and packer 22 may be formed integrally on a single tool body or may be constructed separately and joined together by box and pin sections (not shown) as is known in the art. Alternatively, more than one part may be integrally formed and joined to other individual or multiple parts. In a preferred embodiment the bottom hole assembly is the TRIDENT@ system available from Ardyne Technologies Limited.

In use, as is shown in FIGS. 1A-1F, the assembly 10 is provided by mounting on a drill string 23, the bottom hole assembly 28 in the order from the first end 16, the cutting mechanism 18, the anchor mechanism 20A and the packer 22. The further anchor mechanisms 20B-D are arranged along the work string 23 from the bottom hole assembly 28. There may also be a drill 19 mounted on the end 16 for dressing a cement plug 21 already located in the casing 14. Alternatively, a bridge plug (not shown) could replace the drill 19 and be set in the casing 14 in place of the cement plug 21. Provision of a bridge plug, located at a distal end of the work string 23 below the cutting mechanism 18 would involve mounting a bridge plug on the end of the work string 10 to allow setting of a bridge plug in the casing 14 prior to casing cutting being achieved on the same trip into the wellbore.

The work string tool 10, with none of packer 22, anchor mechanisms 20A-E and cutting mechanism 18 having been actuated, is run-in the wellbore 12 and casing 14 until it reaches the cement plug 21. At this point a wellbore integrity test can be performed using the anchor mechanism 20 and the packer assembly 22, if desired. With the cutting mechanism 18, anchor mechanism 20 and packer assembly 22 all held in inactive positions, fluid can be pumped at a fluid pressure below a pre-set threshold through the bore 25 of the drill string 23 to hydraulically activate the drill 19. This does not actuate the cutting mechanism 18, anchor mechanisms 20A-E or the packer assembly 22. The drill 19 is used to dress the cement plug 21. This is as illustrated in FIG. 1A.

The work string 23 is then positioned such as to locate the knives 30 of the cutting mechanism 18 at a desired location to cut the casing 14 and a first anchor mechanism 20B at an upper end 24 of the casing 14. It will be appreciated that the upper end 24 of the casing 14 may be a significant length of casing and when the first anchor mechanism 20B is set, the string 23 will have to be raised to locate the first anchor mechanism 20B at the end of the casing 14. At this position, the lowermost anchor mechanism 20A is actuated to grip 26 the inner wall 17 of the casing 14 to secure the axial position of the assembly 10 in the wellbore 12.

Once the lowermost anchor mechanism 20A has engaged the casing 14 and is set, as illustrated in FIG. 1B, the cutting mechanism 18 can be actuated. Note that actuation of lowermost anchor mechanism 20A means that the casing 14 is held in tension when the cutting mechanism 18 is operated. This provides a cleaner cut. Blades 30 extend and the work string 23 is rotated to rotate the blades 30 and this cut the casing 14. As the lowermost anchor mechanism 20A is set and is adjacent the cutting mechanism 18, vibration in the assembly 28 and the effects of chatter on the blades 30 are mitigated. Circulation is maintained through the bore of the work string 23 so as to flush cuttings away and, for the preferred embodiment, to be recirculated through assembly 28 to collect cuttings for retrieval. This is as illustrated in FIG. 1C. During the cutting operation the anchor mechanism 20A remains substantially stationary relative to the cutting mechanism 18, with rotation of the cutting mechanism being made possible via a bearing in the lowermost anchor mechanism 20A. In an alternative embodiment, a downhole motor is positioned between the lowermost anchor mechanism 20A and the cutting mechanism 18, so that the bearing is not required and the cutting mechanism 18 is operated without a requirement to rotate the work string 23. It is noted that upward flow travels in the annulus 32 passed the packer 22 without any obstructions in the annulus 32 at the location of the packer 22 as it is, at this time, not actuated. Should a kick occur in the wellbore 12 for any reason, the packer 22 can be rapidly actuated and set to seal the wellbore 12.

When the cutting mechanism 18 has finished cutting the casing 14, providing a cut 29, the cutting mechanism 18 is deactivated. The knives 30 move to a retracted position. The lowermost anchor mechanism 20A is also unset. There is now a cut section of casing 43 in the wellbore 12. At this time, the first anchor mechanism 20B is actuated to grip 34 the upper end 24 of the cut casing section 43. In order to do this the work string 23 may be adjusted to position the first anchor mechanism 20B at the end of the casing and thereby actuate the grippers 34. Note this is a small adjustment and does not require any breaking out or making up of the work string 23. The FRM spear as described in WO2017182549 advantageously only actuates when a portion is lifted above the end of the casing 14. In this way, the anchor mechanisms 20B-D may be identical and thus the others will not operate when the first anchor mechanism 20B is actuated. This is as illustrated in FIG. 1D.

With the first anchor mechanism 20B now gripping the cut section of casing 43, the work string 23 is pulled to see if the cut section of casing 43 is free and will lift. If this occurs the first anchor mechanism 20B is released. The work string 23 is then pulled through the cut section of casing 43 to position the lowermost anchor mechanism 20A at the upper end 24 of the cut section of casing 43. The lowermost anchor mechanism 20A is then set again to grip 26 the inner wall 17 at the upper end 24. This is as illustrated in FIG. 1E.

By pulling the work string 23 from the wellbore 12, the cut section of casing 43 is removed from the wellbore 12. The wellbore 12 now contains the casing stub 45 and cement plug 21 as shown in FIG. 1F.

While it will be recognised that the cut section of casing 43 could have been removed in the arrangement of FIG. 1D using the first anchor mechanism 20B, this is not done. Those skilled in the art will realise that this would require the disassembly of an inner string i.e. the work string 23 inside the casing 43 at surface which is difficult to achieve as slips need to be set against the work string 23 once the first anchor mechanism 20B is removed from the string 23. Thus locating the lowermost anchor mechanism 20A at the upper end 24 of the casing section 43 removes this difficulty as we are at the end of the work string 23 when the casing 43 arrives at surface.

Figures 2A, 2B, 2C, 2D, 2E:
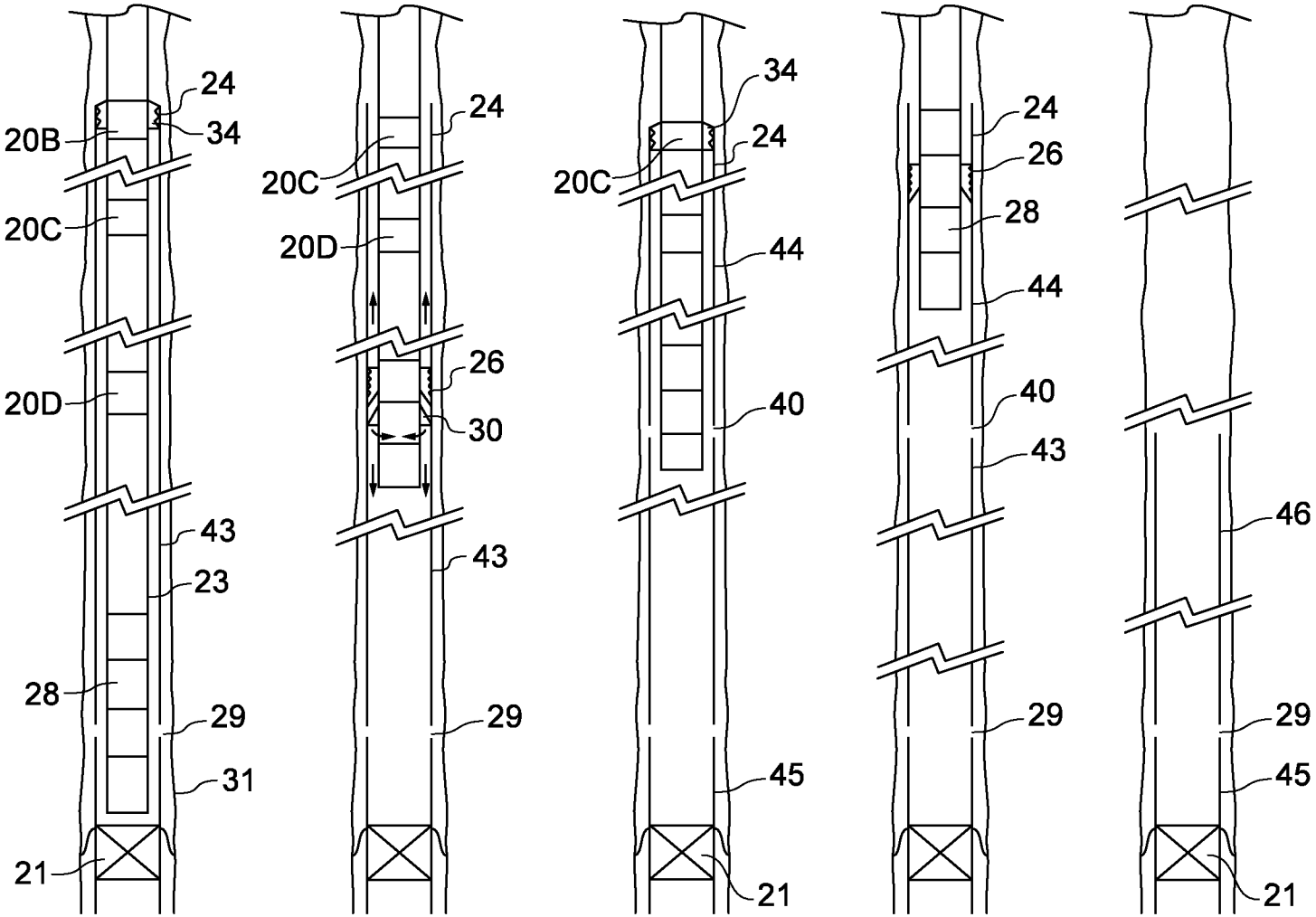
FIGS. 2A to 2E provide schematic illustrations of further steps in the method of FIG. 1.

If, when the upward pull is applied to the cut section of casing 43 in the arrangement of FIG. 1D no movement is detected, it is assumed that cement or other debris is located in the annulus between the cut casing 43 and the formation 31 which will prevent movement and subsequent recovery of the cut casing section 43. We now refer to FIGS. 2A-2E which illustrate further steps in the method or recovering casing according to an embodiment of the present invention. FIG. 2A is a reproduction of FIG. 1D illustrating the first anchor mechanism 20B attempting a pull. When the pull is unsuccessful, the work string 23 is then pulled up through the casing 14 to locate the knives 30 of the cutting mechanism 18 at a location higher in the wellbore 12 on the cut casing section 43 as is shown in FIG. 2B. A second anchor mechanism 20C is now positioned at the upper end 24 of the cut section of casing 43. The lowermost anchor mechanism 20A is actuated to grip the inner wall 17 of the cut section of casing 43 and the cutting mechanism 18 actuated as described herein before with reference to FIG. 1C. Thus a new cut 40 is formed in the casing 14. As before the cutting mechanism 18 is deactivated. The knives 30 move to a retracted position. The lowermost anchor mechanism 20A is also unset. There is now a shorter cut section of casing 44 in the wellbore 12. At this time, the second anchor mechanism 20C is actuated to grip 34 the upper end 24 of the cut casing section 44. This is as illustrated in FIG. 2C.

The work string 23 is again pulled to see if the now shorter section 44 of cut casing is free and will lift. If this occurs the second anchor mechanism 20C is released. The work string 23 is then pulled through the cut section of casing 44 to position the lowermost anchor mechanism 20A at the upper end 24 of the cut section of casing 44. The lowermost anchor mechanism 20A is then set again to grip 26 the inner wall 17 at the upper end 24. This is as illustrated in FIG. 2D and is equivalent to FIG. 1E.

By pulling the work string 23 from the wellbore 12, the shorter cut section of casing 44 is removed from the wellbore 12. The wellbore 12 now contains the casing stub 45, a cut section of stuck casing 46 and the cement plug 21 as shown in FIG. 2E. Cement can now be deposited onto the casing stub 45 to fill the wellbore and thus create a barrier meeting the well abandonment requirements. Alternatively, a work string could be run back in to connect a casing spear to the top of the stuck casing section 45 and see if now shorter stuck section of casing 46 can be pulled free.

By testing a pull with the anchor mechanism 20B and the test failing we have saved the time in breaking up the work string 23 to raise the lowermost anchor mechanism 20A to the upper end 24 of the cut casing section 43 and then, following a failed test pull, making up the work string 23 to run the string 23 back through the cut casing section 43 to a new location to make the second shallower cut 40.

It will be realised that in the event that the second anchor mechanism 20C fails to pull the shorter cut section of casing 44, then the steps shown in FIG. 2A-2C can be repeated at increasingly shallower depths and with progressively lower positioned anchor mechanisms 20D until a cut section of casing can be pulled and recovered from the wellbore 12. Significant rig time is saved in not having to raise the work string 23 to position the lowermost anchor mechanism 20A at the upper end 24 of the casing 14 to perform the pull test.

Figures 3A, 3B, 3C, 3D, 3E, 3F:
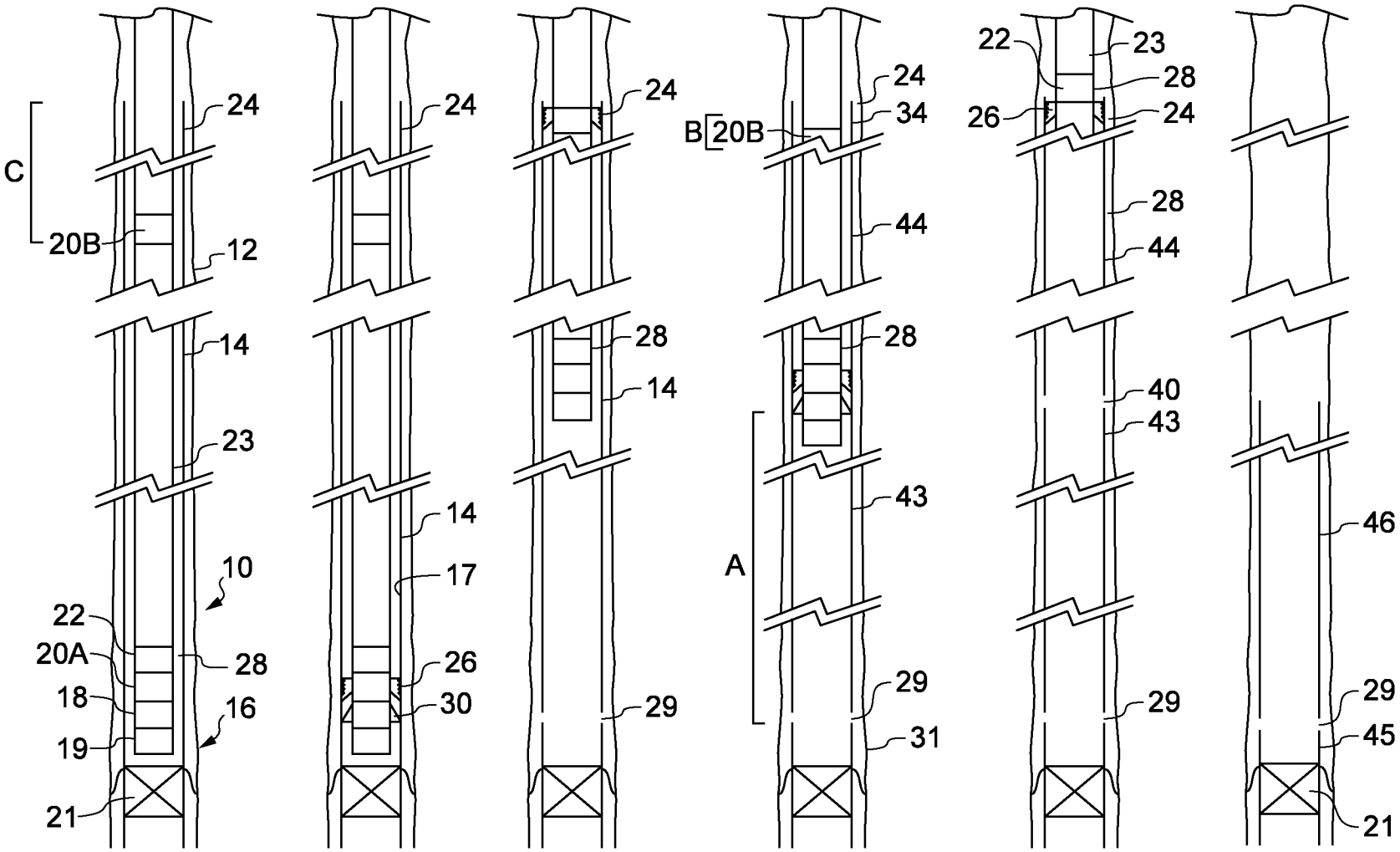
FIGS. 3A to 3F provide schematic illustrations of a method according to a further embodiment of the present invention.

Reference is now made to FIGS. 3A-F which illustrates a further method of removing casing from a well bore according to a further embodiment of the present invention. Like parts to those of FIGS. 1A-F have been given the same reference numerals to aid clarity. Referring initially to FIG. 3A of the drawings there is illustrated a downhole casing cutting and removal assembly, generally indicated by reference numeral 10, according to an embodiment of the present invention run into a wellbore 12 which is lined with casing 14 or other tubular. Assembly 10 is the same as that for FIG. 1 with a bottom hole assembly 28 comprising a cutting mechanism 18, a lowermost or first anchor mechanism 20A and a packer 22. The bottom hole assembly 28 is attached to a work string 23. In this embodiment there is a second anchor mechanism 20B spaced apart along the work string 23 from the first anchor mechanism 20A.

In this embodiment, the spacing of components along the work string 23 and with respect to the casing 14 has been arranged according to distances within the wellbore 12. In this case an operator will predetermine that in the event that a pull cannot be made after the first cut, the second cut will be a set distance A above the first cut, say 100 m for example. The second anchor mechanism 20B is then positioned on the work string 23 so that when the cutting mechanism 18 is at the first depth for making the first cut, the second anchor mechanism 20B is positioned below the upper end 24 of the casing 14, by a distance C equal to A+B, were B is a short distance, say 3 m in our example. Significantly, B will be much smaller than A. This is as illustrated in FIG. 3A.

With the cutting mechanism 18 at the first depth, the first anchor mechanism 20A is set to grip the casing 14 and hold it in tension while the first cut 29 is made using cutting blades 30, as illustrated in FIG. 3B. To undertake a test pull on the cut section of casing 43, the work string 23 is raised by the distance C i.e. 103*m* in our example. The second anchor mechanism 20B will now be positioned at the upper end 24 of the cut section of casing 43. The second anchor mechanism 20B is set to grip the upper end 24 of the casing 43 and a test pull made to see if the cut section of casing 43 is free. This is illustrated in FIG. 3C. If free, the steps described hereinbefore with reference to FIGS. 1E and 1F will be performed to remove the cut section of casing 43.

In the event that the cut section of casing 43 cannot be pulled by raising the second anchor mechanism 20B, the second anchor mechanism 20B is unset and the work string is lowered by the distance C. The cutting mechanism 18 will now be positioned at the second depth for the second cut 40, with the second depth being shallower than the first. The second cut 40 will be a distance A above the first cut as required. The work string 23 will only have had to be lowered by a short distance B, to position the cutting mechanism 18 at the second depth. This is as illustrated in FIG. 3D, with the first anchor mechanism 20A set and the blades 30 making the second cut 43.

Once the second cut is made, the work string 23 need only be raised by the short distance B to set the second anchor 20B at the upper end 24 of the now shorter cut section of casing 44. This will be as illustrated as for FIG. 3C with the second cut 40 made. The work string 23 is again pulled to see if the now shorter section 44 of cut casing is free and will lift. If this occurs the second anchor mechanism 20B is released. The work string 23 is then pulled through the cut section of casing 44 to position the first anchor mechanism 20A at the upper end 24 of the cut section of casing 44. The first anchor mechanism 20A is then set again to grip 26 the inner wall 17 at the upper end 24. This is as illustrated in FIG. 3E and is equivalent to FIG. 2D.

By pulling the work string 23 from the wellbore 12, the shorter cut section of casing 44 is removed from the wellbore 12. The wellbore 12 now contains the casing stub 45, a cut section of stuck casing 46 and the cement plug 21 as shown in FIG. 3F. Cement can now be deposited onto the casing stub 45 to fill the wellbore and thus create a barrier meeting the well abandonment requirements. Alternatively, a work string could be run back in to connect a casing spear to the top of the stuck casing section 45 and see if now shorter stuck section of casing 46 can be pulled free.

In this embodiment it is preferred that the bottom hole assembly 28 is the TRIDENT® System available from Ardyne Technologies Limited. The second anchor mechanism 20B is preferably the FRM spear available from Ardyne Technologies Limited. Advantageously, the short distance B is sufficient to activate and deactivate the FRM spear by entry and exit from the upper end 24 of the cut section of casing 43,44.

The principal advantage of the present invention is that it provides a method of casing cutting and removal in which test pulls can be made following cutting of the casing without having to raise the bottom hole assembly on the work string to the top of the cut casing section for each test.

A further advantage of at least one embodiment of the present invention is that it provides multiple casing spears on a string which can all be identical with only the uppermost spear being actuated when required.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended. For example whilst the above embodiments have been described as including a packer, it would be possible for the assembly 10 to operate without inclusion of a packer.

We claim:

1. A method of removing casing from a wellbore, comprising the following steps, performed on a single trip, in order:

(a) providing a work string including:

a cutting mechanism configured to cut a tubular in the wellbore; and a first anchor mechanism and a second anchor mechanism, each anchor mechanism configured to grip an inner wall of the tubular in a wellbore; and wherein the cutting mechanism is positioned towards a lower end of the work string and the first and the second anchor mechanisms are spaced apart along the work string above the cutting mechanism, the first anchor mechanism being arranged between the cutting mechanism and the second anchor mechanism;

(b) running the work string in the well bore to position the cutting mechanism at a first depth in the tubular;

(c) actuating the cutting mechanism to cut the tubular to form a cut section of tubular above the position of the cutting mechanism;

(d) actuating the second anchor mechanism to grip the cut section of tubular;

(e) pulling the work string to check that the cut section of tubular is free;

(f) releasing the second anchor mechanism;

(g) pulling the work string up through the wellbore so as to position the first anchor mechanism towards an upper end of the cut section of tubular;

(h) actuating the first anchor mechanism to grip the cut section of tubular; and (i) pulling the work string from the well bore to remove the cut section of tubular from the wellbore.

2. A method of removing casing from a wellbore as claimed in claim 1 wherein the lowermost anchor mechanism is mounted above and in proximity to the cutting mechanism.

3. A method of removing casing from a wellbore as claimed in claim 2 wherein the method includes providing the lowermost anchor mechanism and the cutting mechanism as a bottom hole assembly.

4. A method of removing casing from a wellbore as claimed in claim 3 wherein the method includes providing a bottom hole assembly further including a packer.

5. A method of removing casing from a wellbore as claimed in claim 1 wherein in step (d), the work string is moved to position the second anchor mechanism towards the upper end of the cut section of casing.

6. A method of removing casing from a wellbore as claimed in claim 1 which further includes the step of actuating the lowermost anchor mechanism during step (c).

7. A method of removing casing from a wellbore as claimed in claim 1 wherein, in the event that the cut section of tubing is not free in step (e), the method includes these additional steps between steps (f) and (g):

f(1) positioning the cutting mechanism at a shallower depth in the tubular;

f(2) actuating the cutting mechanism to cut the tubular to form a shorter cut section of tubular above the position of the cutting mechanism;

f(3) actuating the second anchor mechanism to grip the shorter cut section of tubular;

f(4) pulling the work string to check that the cut section of tubular is free; and f(5) releasing the second anchor mechanism.

8. A method of removing casing from a wellbore as claimed in claim 7 wherein the method includes the step of lowering the work string in step f(1).

9. A method of removing casing from a wellbore as claimed in claim 7 wherein the method includes the step of actuating the first anchor mechanism during step f(2).

10. A method of removing casing from a wellbore as claimed in claim 7 wherein the method includes the step of raising the work string between steps f(2) and f(3).

11. A method of removing casing from a wellbore as claimed in claim 1 wherein the method includes the step of locating a third anchor mechanism on the work string with the third anchor mechanism located between the first and second anchor mechanisms.

12. A method of removing casing from a wellbore as claimed in claim 11 wherein in the event that the cut section of tubing is not free in step (e), the method includes these additional steps between steps (f) and (g):

f(1) positioning the cutting mechanism at a shallower depth in the tubular;

f(2) actuating the cutting mechanism to cut the tubular to form a shorter cut section of tubular above the position of the cutting mechanism;

f(3) actuating the third anchor mechanism to grip the shorter cut section of tubular;

f(4) pulling the work string to check that the cut section of tubular is free; and f(5) releasing the third anchor mechanism.

13. A method of removing casing from a wellbore as claimed in claim 12 wherein the additional steps are repeated at successively shallower depths and with other anchor mechanisms on the work string until a cut section of tubular is free.

14. A method of removing casing from a wellbore as claimed in claim 1 wherein the method comprises hydraulically or pneumatically actuating the anchor mechanisms.

15. A method of removing casing from a wellbore as claimed in claim 1 wherein the method comprises mechanically setting the actuated anchor mechanisms.

16. A method of removing casing from a wellbore as claimed in claim 3 wherein the method comprises setting the anchor mechanisms by providing an upward force or tension to the bottom hole assembly.

17. A method of removing casing from a wellbore as claimed in claim 1 wherein the method comprises actuating the cutting mechanism by pumping a fluid into a bore of the work string and rotating the cutting mechanism to cut the casing.

18. A method of removing casing from a wellbore claimed in claim 17 wherein the cutting mechanism is rotated by rotating the work string.

19. A method as claimed in claim 17 wherein the cutting mechanism is rotated via a downhole motor arranged between the lowermost anchor mechanism and the cutting mechanism.

* * * * *